US006826857B1

(12) United States Patent
Bachmann

(10) Patent No.: US 6,826,857 B1
(45) Date of Patent: Dec. 7, 2004

(54) PERPETUAL CALENDAR

(76) Inventor: Anders Bachmann, 77-D Forest Rd., Storrs, CT (US) 06268

( * ) Notice: Subject to any disclaimer, the term of this patent is extended or adjusted under 35 U.S.C. 154(b) by 0 days.

(21) Appl. No.: 10/294,967

(22) Filed: Nov. 14, 2002

(51) Int. Cl.[7] ..... G09D 3/06
(52) U.S. Cl. ..... 40/114; 40/111
(58) Field of Search ..... 40/107, 111, 113, 40/114, 118

(56) References Cited

U.S. PATENT DOCUMENTS 2,340,153 A * 1/1944 Stewart ..... 40/107
3,694,943 A * 10/1972 De Filippo ..... 40/113
4,187,629 A * 2/1980 Yamada ..... 40/109
4,376,346 A * 3/1983 Nelson ..... 40/114
5,313,723 A * 5/1994 Cregg ..... 40/113
5,657,561 A * 8/1997 Zykov ..... 40/118
5,950,338 A * 9/1999 Lin ..... 40/114

* cited by examiner

*Primary Examiner*—Andrew D. Wright
(74) *Attorney, Agent, or Firm*—McCormick, Paulding & Huber LLP

(57) ABSTRACT

A perpetual calendar for displaying a monthly calendar by aligning the desired monthly indicia with an appropriate yearly indicia. The calendar is based on a repeating five element pattern representing a four year repeating pattern, which, however, is modified for non-leap year centuries.

5 Claims, 4 Drawing Sheets

PERPETUAL CALENDAR

FIELD OF THE INVENTION

The invention relates generally to the field of calendars and, more particularly, to perpetual calendars.

BACKGROUND OF THE INVENTION

Perpetual calendars are calendars that can be manipulated to display various different periods of time, such as weeks or months. Perpetual calendars are based upon the known yearly cycle of time as quantified by the months and days.

Many perpetual calendars function by aligning a day of the week, e.g., Monday, Tuesday, with the day on which January $1^{st}$ of a given year falls. Once the day of the week on which January $1^{st}$ falls in a given year is known, the dates and corresponding days of the weeks within that year are known based on the known number of days within a week and the dates in each month.

Year to year changes on the day of the week on which January $1^{st}$ falls are taken into account based on the fixed number of days in a week and the known number of days in a year. While all weeks have seven days, the number of days in a year varies.

All years have 365 days, unless the year is a leap year, which has 366 days. A leap year is any year divisible by 4, except where the year is a century, e.g. 2000, 2100, which is only a leap year if also divisible by 400. Thus, the century 2000 was a leap year but the century 2100 will not be. The known number of days in a year combined with a fixed week of seven days mandates that January $1^{st}$ of a year following a 365 day year begin on the next day of the week from which that year began. For example, if January $1^{st}$ of a 365-day year was on a Monday, the January $1^{st}$ of the following year will be on a Tuesday. In the special case where a year follows a leap year, the January $1^{st}$ of the following year is not one day later but two, to account for the extra day in the 366-day year. For example, if January $1^{st}$ of a 366-day year was on a Monday, January $1^{st}$ of the following year will be on a Wednesday. The day of which January $1^{st}$ falls in preceding years may be similarly obtained.

Over the years there have been many structures for perpetual calendars. Many of the calendars, however, do not simultaneously display the days, dates, months and year. Most display only a month with the days and dates therein. In addition, changing the relationship in the calendar to reflect for example months in a different year, particularly a leap year, is complex. Generally, most perpetual calendars make the assumption that a viewer of the calendar is only interested in the current month.

Based on the above, it is an object of the present invention to create a perpetual calendar that is more readily adaptable to changing the relationships depicted thereon.

It is another object of the present invention to create a perpetual calendar that more easily accommodates leap years.

It is still yet another object of the present invention to create a perpetual calendar that displays the entire relationship between the dates, days, months and years.

SUMMARY OF THE INVENTION

The present invention in one aspect is a perpetual calendar having a body with an outer surface. The outer surface is divided into seven segments, the number of segments corresponding to the number of days in a week. Date indicia for the longest month in a year, 31 indicia in all, are successively positioned on the outer surface in the seven segments. At least five-year indicia, representing a repeating pattern based on four years, are also positioned on the outer surface in each segment. The year indicia positioned in any one segment are based on the date indicia therein.

A cap is positioned relative the body and has an outer surface. Positioned on the outer surface of the cap are day indicia and month indicia. The day indicia and month indicia are positioned in a fixed relationship and define seven sections. The seven sections are consistent with the seven segments on the body such that a section aligns with a segment. The cap is positionable about the body permitting the seven sections to align with the seven segments to display a one month calendar for each aligned month and year. Preferably, the cap does not interfere with the viewing of the indicia of at least one month and corresponding year on the body, thus permitting the day, date, month and year to be simultaneously viewed.

The indicia within any segment or section can be arranged as desired therein. In addition, additional month ending indicia, indicia to indicate the last day of month, can be added to the segment having the day indicia that indicates the last day of a month. For example, "Apr" can be added in the segment having day indicia 30 to indicate that April has 30 days.

DETAILED DESCRIPTION OF THE PREFERRED EMBODIMENT

Figure 1:
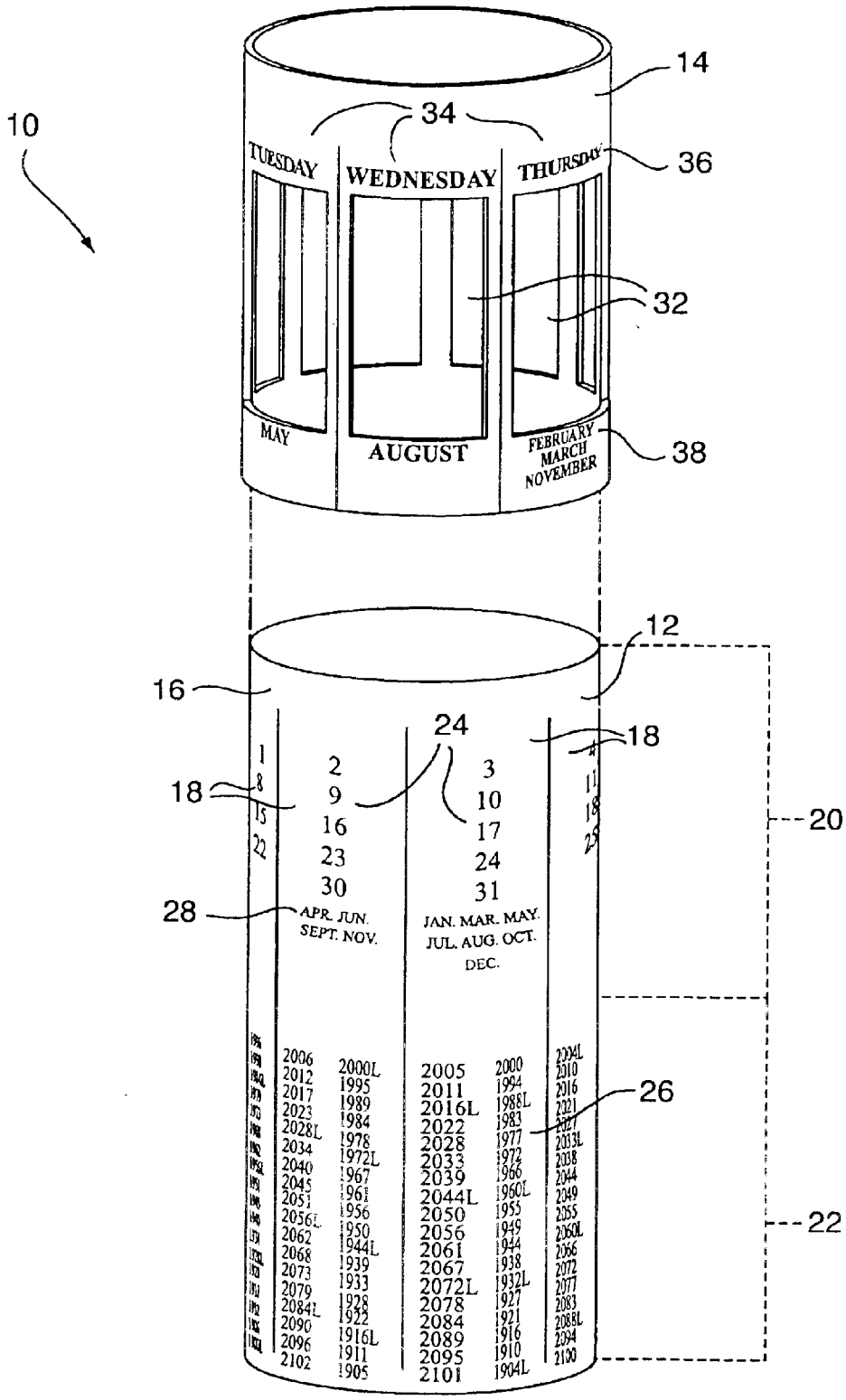
FIG. 1 is an exploded side perspective view of one embodiment of a perpetual calendar according to the present invention.
Figure 2:
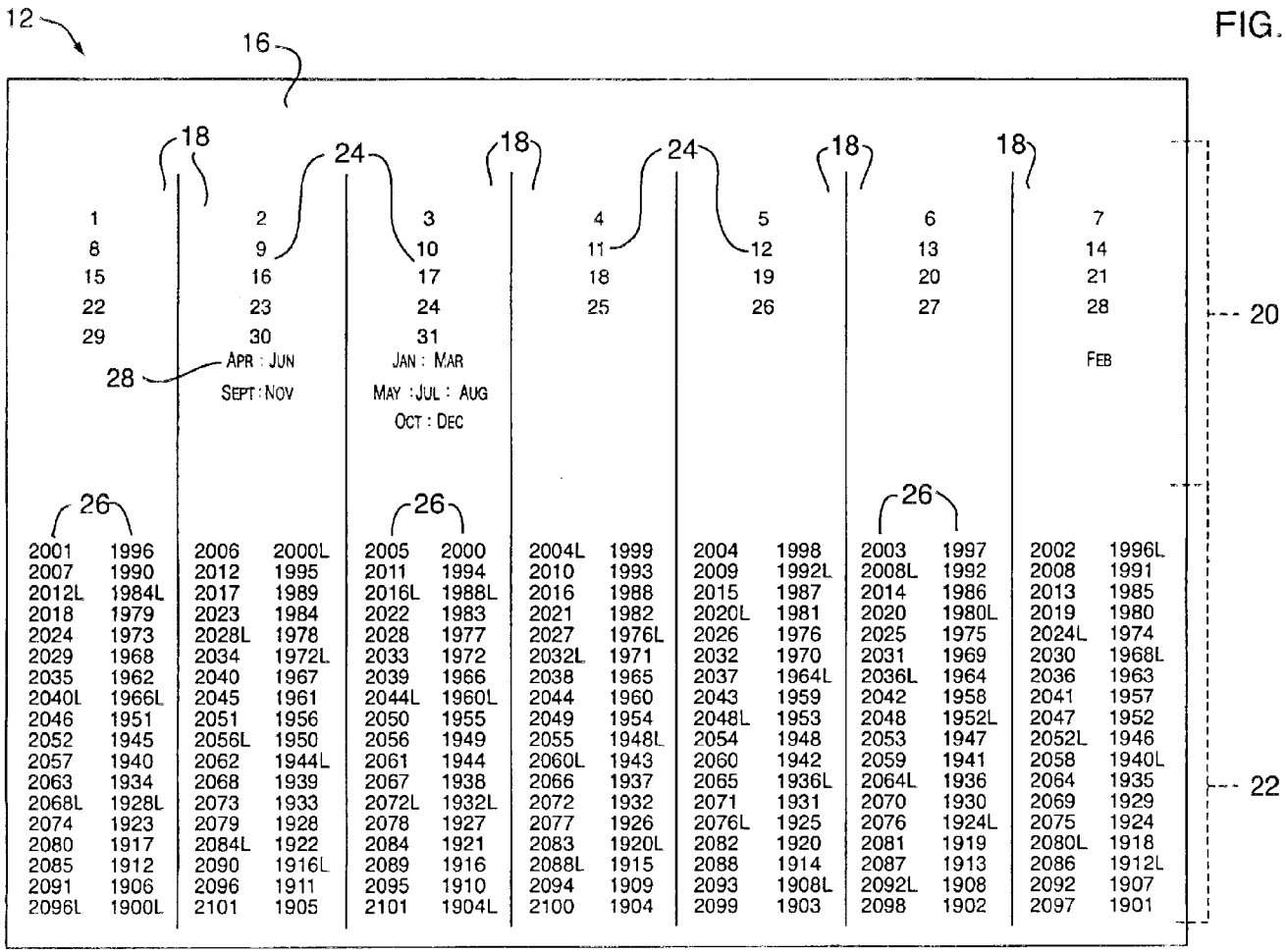
FIG. 2 is a table illustrating the placement of date indicia, year indicia and month ending indicia within the segments of the cylindrical body of the perpetual calendar depicted in FIG. 1

As shown in FIG. 1, a perpetual calendar, generally denoted by the reference number 10, includes a cylindrical body 12 and a rotating cap 14. Referring to FIGS. 1 and 2, the cylindrical body 12 has an outer surface 16 which is divided into seven segments 18. Each segment 18 is divided into a first portion 20 and a second portion 22, the demarcation of which is denoted by a dotted line.

On the cylindrical body 12 within each segment 18 in the first portion 20, date indicia 24, in this case numbers, are sequentially positioned. As used herein sequentially positioned means positioning an indicia within a segment with the next sequential indicia positioned in an adjacent segment and so forth.

Figure 3:
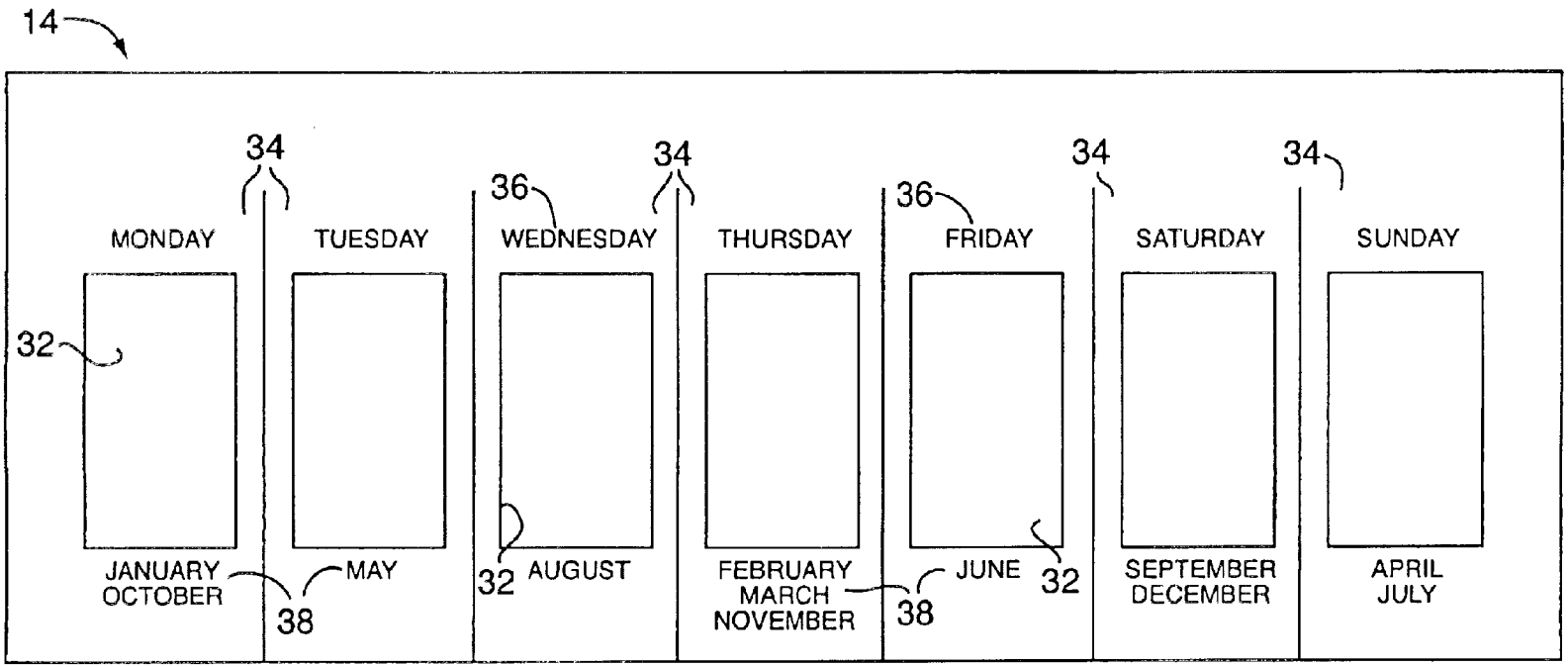
FIG. 3 is a table illustrating the placement of day indicia and month indicia within the sections of the rotating cap of the perpetual calendar depicted in FIG. 1.

Within each segment 18 in the second portion 22 is at least one year indicia 26 that corresponds to the date indicia 24 already positioned within the segment 18. As this is a perpetual calendar, there is a fixed relationship between the date indicia 24 and the year indicia 26. This fixed relationship is based upon the known number of days in the year, 365 or 366, and the fixed pattern of days, weeks and months that define a year. Similarly. the perpetual calendar 10 includes a fixed relationship between the day indicia 36 and month indicia 38 that corresponds with the fixed relationship between the date indicia 24 and year indicia 26. FIG. 2 provides a layout of date indicia 24 and year indicia 26. FIG. 3 provides a layout of day indicia 36 and month indicia 38. While FIG. 2 is complete as to the layout of the date indicia 24, it only contains a partial layout of the year indicia 26. A method for laying out additional year indicia 26 is discussed below.

In addition, within appropriate segments 18 in the first portion 20 are month ending indicia 28. Month ending indicia 28 identify on the calendar 10 the end of a given month. Each month ending indicia 28 is placed to coincide with the date indicia 24 indicating the last day of a month. For example, the month ending indicia 28 for April, "Apr," is positioned in the segment 18 wherein the date indicia 24 represents the $30^{th}$ day.

The rotating cap 14 fits over the outer surface 16 of the first portion 20 of the cylindrical body 12. The rotating cap 14 defines at least one opening 32. The openings 32 permit the date indicia 24 and the month ending indicia 28 positioned on the outer surface 16 of the cylindrical body 12 to be framed and viewed. As shown in FIG. 1, a preferred embodiment of the present invention includes a rotating cap 14 that defines seven openings 32, one corresponding to each of the segments 18. The rotating cap 14 could also be designed such that no openings 32 are required, or that any number of openings 32 are provided.

The rotating cap 14 is radially divided into seven sections 34 that are consistent in arc segment with the seven segments 18. Consistent arc segments for the sections 34 and segments 18 assures that when the rotating cap 14 is repositioned on the cylindrical body 12, the sections 34 and segments 18 are alignable. Each section 34 includes day indicia 36 and month indicia 38 in a fixed relationship that is appropriately alignable with the fixed relationship between the date indicia 24 and year indicia 26 in each segment 18 of the cylindrical body 12. FIG. 3 illustrates a complete layout for each section 34.

As indicated above, the layout for the cylindrical body 12 is only a partial layout as it depicts only some number of years. Predominately, the number of years can be increased by following a standard pattern. The standard pattern representing four years has five elements, i.e. x, x+1, x+2, x+3, x+4, x+4. The last two elements are for a single leap year.

An example of the pattern as applied to years is as follows—2001, 2002, 2003, 2004, 2004. The next repeat would be 2005, 2006, 2007, 2008, 2008. In the previous patterns, years 2004 and 2008 are leap years. As it is important for operation of the perpetual calendar 10, which is explained below, to distinguish between the two year indicia 26 for a single leap year the second leap year indicia 26 is highlighted, such as with the letter "L."

This pattern, however, is modified in one unique case. As those who understand calendars appreciate, all centuries are not leap years. A leap year is generally defined as any year divisible by 4. While all centuries are divisible by 4, a century is a leap year only if it is also divisible by 400. Thus the century 2000 is a leap year while the centuries 1900, 2100, 2200 and 2300 are not. In this unique case the pattern is altered by deleting the second duplicate entry.

To use the perpetual calendar 10, the segments 18 of the cylindrical body 12 and the sections of the rotating cap 14 must be properly aligned. In one procedure for using the perpetual calendar, the first step is to determine if the year desired is a leap year or not. As explained above, for each leap year there are two year indicia 2, e.g. 2004 and 2004L, in adjacent segments. If the year is not a leap year, there is only one year indicia 26. In the non-leap year case, aligned the desired month indicia 38 with the desired year indicia 26. For the aligned month and year, a one month calendar will be displayed. In the case of a leap year, if the desired month is January or February align the appropriate month indicia 38 with the first year indicia 26, e.g., 2004. For all other months in the leap year, align the desired month indicia 38 with the second year indicia 26, e.g., 2004L.

Figure 4:
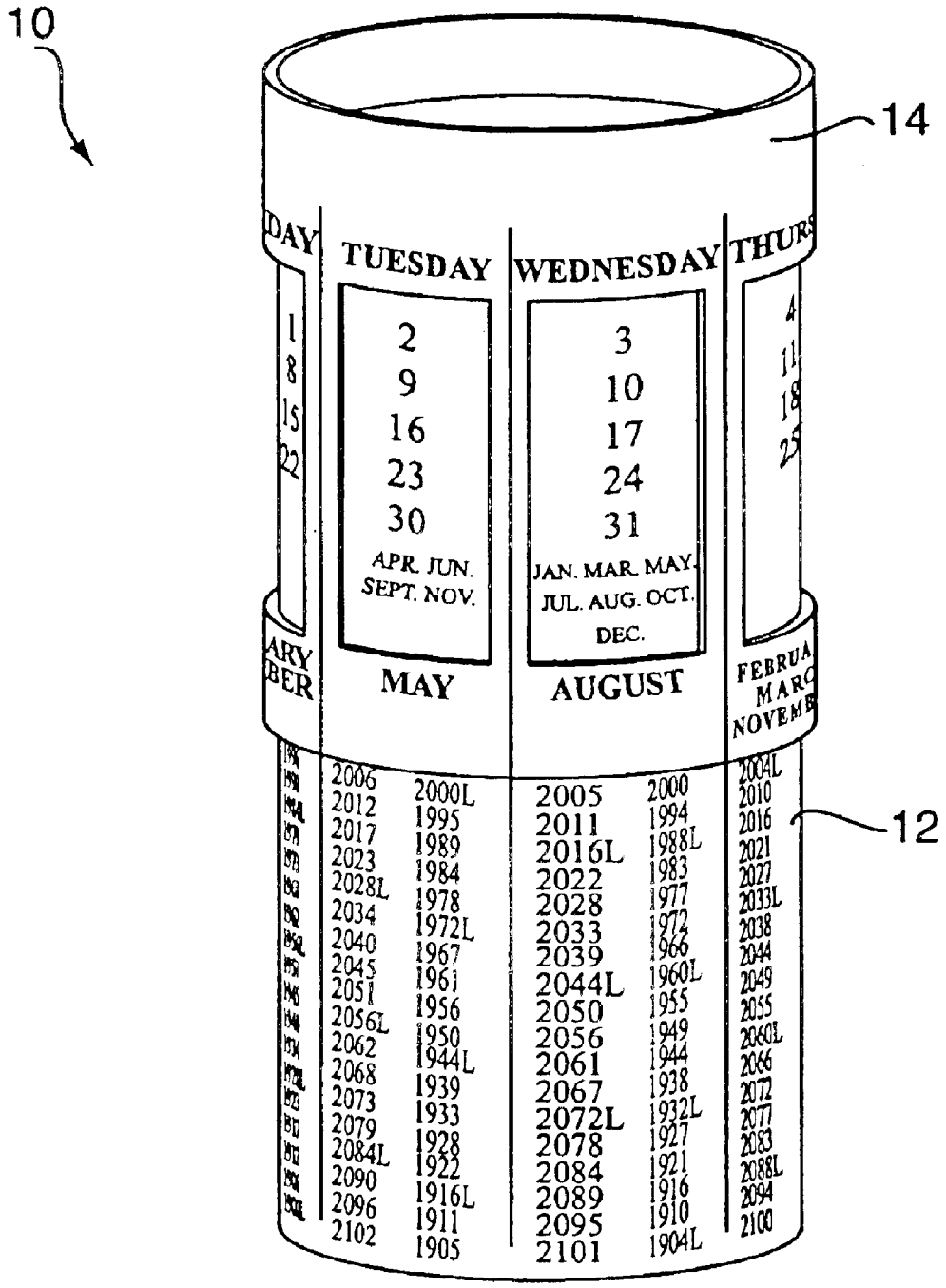
FIG. 4 is an assembly view of the perpetual calendar of FIG. 1.

Referring to FIG. 4. the perpetual calendar 10 can be used to determine the day of the week for a selected date and year. For example, to determine on what day of the week Aug. 17, 2005 will fall, a user positions the rotating cap 14 to align the month indicia 38 portion containing "August" of section 34 with the year indicia 26 containing the year "2005" in segment 18. The user then views the date indicia 24 through the cap opening 32 to locate the number "17" corresponding to the selected date. The corresponding day indicia 36 indicates "Wednesday", which allows the user to thereby determine that Aug. 17, 2005 falls on a Wednesday.

Although the present invention has been described in considerable detail with reference to a certain preferred versions thereof, other versions are possible, particularly versions wherein the indicia within a segment or section are positioned differently, wherein the openings may not be required or additional openings could be used, or the body and cap are not cylindrical. Therefore, the spirit and scope of the invention should not be limited to the description of the preferred versions contained herein.

What is claimed is:

1. A perpetual calendar comprising:

a body having an outer surface divided into seven segments and having thereon date indicia for the longest month in a year successively positioned in the seven segments, at least five year indicia of a repeating cycle positioned successively in segments relevant to the date indicia therein;

a cap having an outer surface divided into seven sections thereon consistent with the seven segments on the body and having day indicia and month indicia positioned in a fixed relationship to the seven sections such that a correct date may be determined for any year, month, and day, the cap being positionable relative to the body such that the seven sections of the cap can be aligned with the seven segments of the body to display the day indicia appropriately with respect to the date indicia for each aligned month and year;

said body and cap being cylindrical, the cap being rotable about the body;

said body having a first portion including the date indicia and a second portion including the year indicia; and wherein the rotatable cap extends over the first portion and defines at least one opening through which the date indicia can be viewed.

2. The perpetual calendar of claim 1 wherein the rotatable cap defines at least seven openings, each opening corresponding to one of said seven sections.

3. The perpetual calendar of claim 1 wherein each opening has opposed sides, and the day indicia is on one side and the month indicia is on the other.

4. The perpetual calendar of claim 1 wherein a month ending indicia is positioned on the outer surface of the body within the segments as follows: 30-month ending indicia of all 30-day months in the segment having ordinal day indicia indicating a $30^{th}$ day therein, a 31-month ending indicia of all 31-day months in the segment having ordinal day indicia indicating a $31^{st}$ day therein, and a 28-month ending indicia of the 28-day months in the segment having ordinal day indicia indicating a $28^{th}$ day.

5. The perpetual calendar of claim 1 wherein the year indicia of leap years is repeated in a successive segment and one of the year indicia of a leap year is highlighted.

* * * * *